United States Patent [19]

Mitsueda

[11] 4,214,410

[45] Jul. 29, 1980

[54] MOBILE HOME EARTHQUAKE SUPPORT

[76] Inventor: Tommy Mitsueda, 909 S. Toland St., Santa Ana, Calif. 92704

[21] Appl. No.: 919,912

[22] Filed: Jun. 28, 1978

[51] Int. Cl.[2] ..... E04B 1/343

[52] U.S. Cl. ..... 52/143; 52/263; 52/DIG. 11; 248/352

[58] Field of Search ..... 52/DIG. 11, 263, 23, 52/143; 248/352

[56] References Cited

U.S. PATENT DOCUMENTS

| | | | |
|---|---|---|---|
| 2,344,383 | 3/1944 | Alexander et al. | 52/143 |
| 3,317,218 | 5/1967 | Rivolta | 248/352 |
| 3,635,434 | 1/1972 | Chartier | 248/352 |
| 3,828,491 | 8/1974 | Koon et al. | 52/23 |
| 3,830,024 | 8/1974 | Warnke | 52/23 |
| 4,064,668 | 12/1977 | Carter | 52/263 |

*Primary Examiner*—William F. Pate, III

*Attorney, Agent, or Firm*—George F. Bethel; Patience K. Bethel

[57] ABSTRACT

The following specification discloses a mobile home support having means for supporting a mobile home during earthquake tremors and wind storms to prevent the collapse thereof. The support comprises an axle support which supports the normally spring weight and is formed from a plate supported by upright stanchions for purposes of accommodating the bolts or lugs of the wheel drums of the mobile home. The stanchions are braced with cross members in angular relationship for purposes of allowing cross lateral stresses to be absorbed within the structure on a basis providing both lateral and axial support. The axle of the mobile home is attached to the cross members with a bracket, thereby creating a cross linked stress support in angularly oriented relationship providing support under the normally sprung load of the mobile home in combination with the axle. A front support at the area where the towing tongue of the mobile home is normally provided is formed with cross stress members going between two stanchions underlying the tongue area of the mobile home and is braced by a longitudinal angular stress member having a bracket for attachment to a rail or frame of the mobile home. The foregoing bracing is adjustable, depending upon the size and characteristics of the mobile home by means of adjustable brackets and heights through different bolt holes.

14 Claims, 11 Drawing Figures

MOBILE HOME EARTHQUAKE SUPPORT

BACKGROUND OF THE INVENTION

1. Field of the Invention

The field of this invention lies within the mobile home support art. More specifically, it lies within the art of supporting a mobile home during severe movements by means of specially adapted structural stanchions, cross members and underlayments for earthquake and wind storm protection.

2. The Prior Art

The prior art related to mobile home supports generally comprises the utilization of concrete piers or stanchions. The concrete piers are implaced under the frame of a mobile home after it has been towed to the location where it is to be set up. The mobile home is then either jacked or held in place at a sufficient level for lowering it onto the concrete piers. Generally, the wheels of the mobile home with the axle support approximately two thirds of the mobile home weight over the spring loaded axle thereof. In addition thereto, a towing tongue that would normally be analogous to a trailer hitch tongue is attached to the front of the mobile home and serves to support approximately one third of the weight of the mobile home during moving operations. Thus, approximately two thirds of the mobile home is supported during its movement over the load bearing axle members are approximately one third with respect to the tongue.

When the mobile home is towed into place it is generally disassociated from its tongue which is connected to underlying brackets having bolts holes that index in the forward part of the mobile home. Thereafter, the mobile home is either jacked or raised in an appropriate manner for placement of the piers under the home. The mobile home generally has a frame which accommodates the concrete piers in a number of different manners. Suffice it to say that the state of the art merely allows for load bearing on the respective concrete piers in a suitable manner.

The mobile home has wheels, wheeldrums, and axles as proviously alluded to that can be in the form of a wheeldrum attached to an axle that is common to the automobile and trucking industry. The wheeldrum rotates on a bearing surface as in the manner of automobile wheels and has a number of lug bolts for receipt of a wheel thereover.

Recently, it has been common to have what is known as an integral wheel and lug arrangement known as a doughnut configuration wherein a singular cup shaped member substitutes for the wheeldrum and the hub. The lug bolts of such doughnut wheeldrums are generally attached through the outside of the doughnut configuration for purposes of receiving the wheel or other member that is to be bolted thereto.

After the mobile home is ready for placement, the concrete piers are slid thereunder in the appropriate places and secured to the mobile home in a number of different manners, such as with bolts or other means for the mobile home to rest thereon.

The piers are generally formed like truncated four sided conical or pyramid members that have been truncated on top for receipt of a frame thereon. They have a spreading base for purposes of placement on the underlying ground or substrate. However, the securement is generally not sufficient for holding a mobile home under earthquake or violent wind forces, because of both the lateral and longitudinal movement, as well as the bouncing movement encountered during an earthquake.

For instance, it was found in the most recent California earthquake that a number of mobile homes were severely damaged because of the fact that they rocked back and forth and moved violently with respect to the movement of the earth. In that particular case, many of the mobile homes were crushed or the concrete piers were driven through the base of the mobile home. In other cases, the mobile home completely split or cracked after it had been moved backwardly and forwardly to the point where the mobile home was ruined. The instant invention overcomes the requirement of having substantial support, footings, or other devices that will not meet the code requirements while at the same time providing protection to a mobile home owner during earthquake and other severe conditions of movement.

In addition to the foregoing advantages against earthquakes, the invention is also of extreme importance during tornados, or violent wind storms to prevent a mobile home from shifting off its supports. It is known that many mobile home in the tornado belt or other areas of the midwest have been damaged severely by being blown over from their piers or shaken violently off their respective supports.

This invention meets the code requirements of the mobile homes not being secured to the ground in the form of a concrete footing, as well as providing a cheap and facile way of providing protection for the mobile home. Thus, it is a substantial step over the prior art and enables one to utilize the existing frame and support structure of the mobile home, while at the same time enhancing the overall protection to prevent the turning, twisting and displacement of the mobile home from its piers.

SUMMARY OF THE INVENTION

In summation, this invention comprises a portable or mobile home support that is attached to and accommodates a mobile home frame configuration at the axle and the towing tongue area where it is normally towed.

The invention employs a plurality of stanchions on a base plate with a support plate spanning said stanchions for accommodating the wheeldrum of a mobile home, both as to structure and the lug bolt configuration thereof. The stanchions are cross stressed by means of cross members that are secured to the axle of the mobile home in an advantageous manner that serves the function of not only securing the cross members, but also clamping the axle to the cross members. In this configuration the axles and cross members form an angularly stressed and cross stressed conformation to enhance the support of the mobile home.

The stanchions are provided with a plurality of height adjusting bolt holes for purposes of moving the stanchions upwardly and downwardly, depending upon the overall height and sprung loaded configuration of the mobile home. The stanchions can be provided with alternative spanning plates or cross support plates for receiving various types of lug hole orientations and configurations to provide a facile and broad range of support for various types of mobile home hubs and wheel drums.

The forward weight of the mobile home which is normally supported on a tongue during movement is supported by this invention through a cross stressed series of stanchions that are attached to the towing tongue bolt hole configuration after the tongue has been removed. The entire configuration of the cross stressed forward members with the bolt hole configuration can be moved upwardly and downwardly and arranged to suit various heights. In addition thereto, a diagonal longitudinal brace is attached to a movable bracket on the frame of the mobile home for providing longitudinal bracing.

The foregoing is entirely made of structural steel and can withstand substantial stresses when an earthquake provides both lateral and longitudinal or vertically oriented vectoral forces on the structure on the mobile home. The above structure tends to support the mobile home, even when it is driven off of its concrete piers to prevent damage thereto by moving with the mobile home over the underlying ground or substrata.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
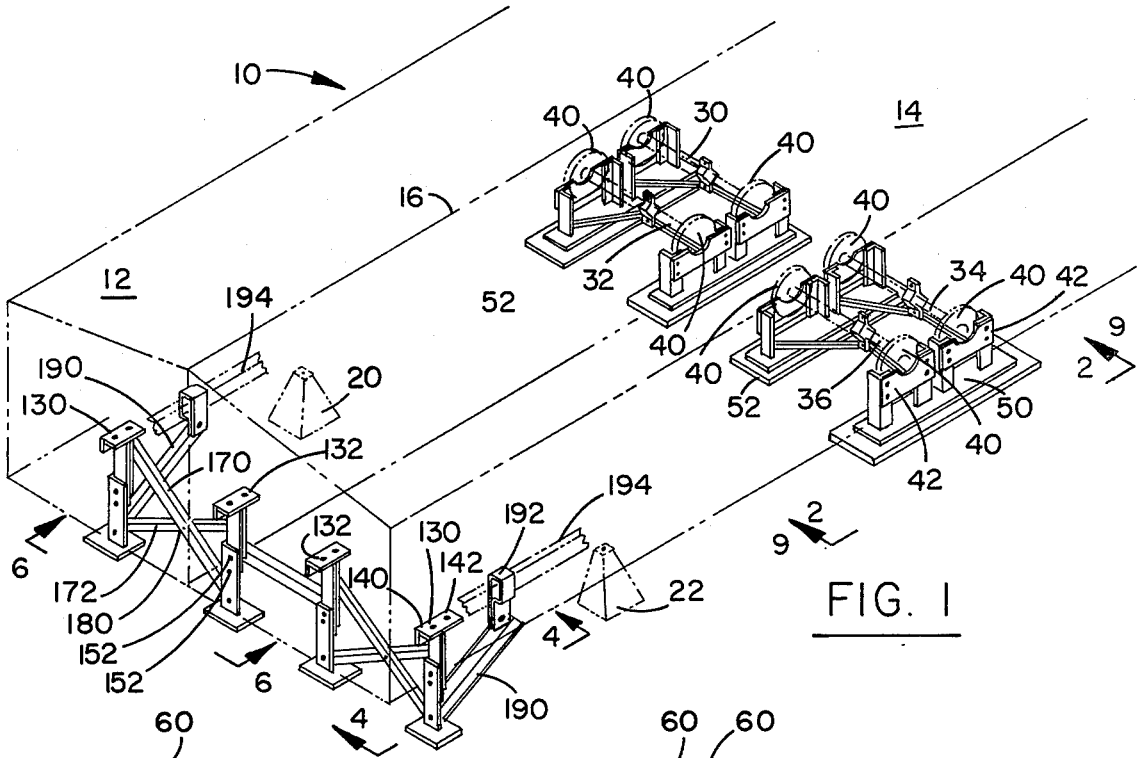
FIG. 1 shows a perspective view of the earthquake support of this invention with a mobile home in dotted configuration thereover which has been fragmented.
Figure 2:
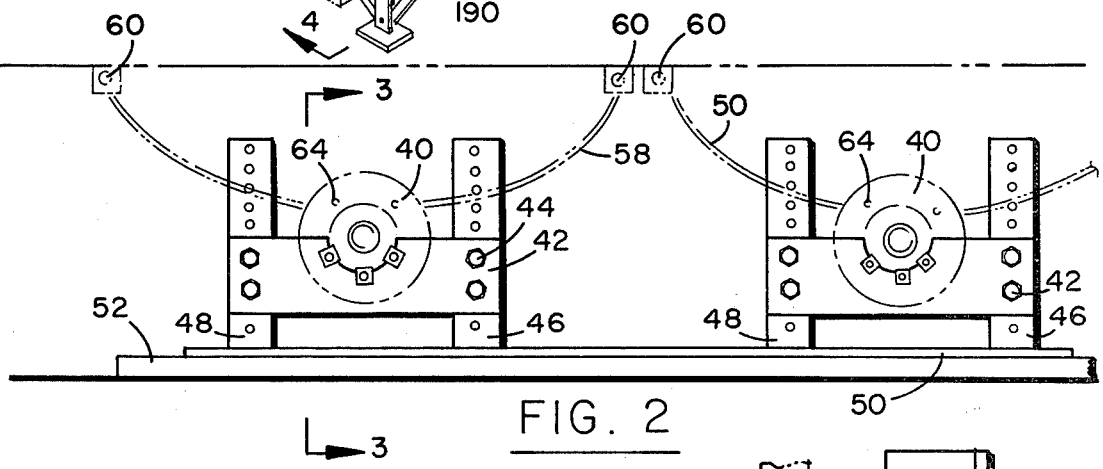
FIG. 2 shows a side elevation view of the support for the axle in the direction of lines 2—2 of FIG. 1.

Looking at FIG. 1 and the figures that are ancillary thereto, it is seen that a fragmented mobile home 10 generally shown in dotted configuration is shown. The home as a left hand side 12 and a right hand side 14, and is split along a center line 16.

It is customary to tow the two respective sections 12 and 14 on axles and wheels by means of a tongue which shall be detailed hereinafter. The two respective sections 12 and 14 are then brought together at the site where they are to be erected and/or maintained. In this case, they are joined along the center line 16 so that both units form an entire large sized mobile home.

It should be appreciated that the foregoing double structures are required because of the fact that mobile home sections larger than the respective sections 12 and 14 cannot be generally towed along the highway. As a concomitant thereto, they must be broken up into sufficiently small units that can be towed as to both length and width. Suffice it to say, the two respective units 12 and 14 each have a pair of axles and wheels for towing, as well as a towing tongue.

Figure 6:
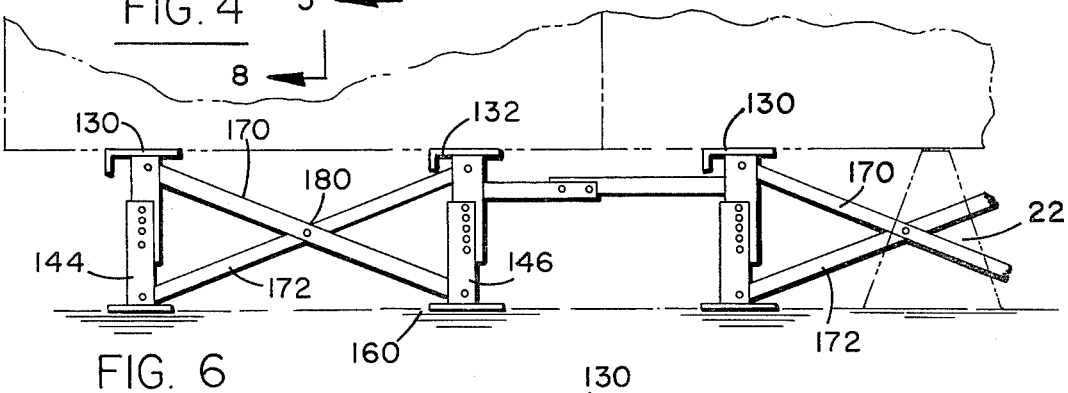
FIG. 6 shows a fragmented front elevation view of the front stanc hion supports of the mobile home in the direction of lines 6—6 of FIG. 1.
Figure 9:
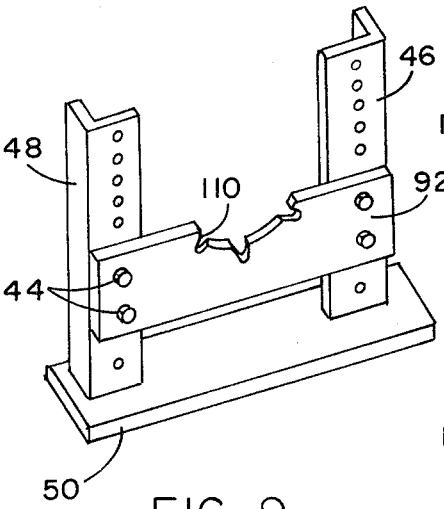
FIG. 9 shows a perspective view of the wheeldrum stanchion support member and cross spanning plate as seen in the direction of lines 9—9 of FIG. 1 wherein only one wheeldrum support has been shown.

After towing in place, the mobile home 10 is then supported by means of truncated four sided concrete pyramids or piers. The piers have been shown to a limited degree at only a limited number of points for purposes of explanation. In particular, piers 20 and 22 have been shown with one of them shown in FIG. 6 placed in an inappropriate position, because of the fragmented relationship of the drawing thereof. The foregoing piers 20 and 22 support the mobile home frame and spread the load over the base of the piers.

The concrete piers and relatively unstable in high wind conditions are during earthquake, due to the fact that the top portion does not secure the mobile home sufficiently. Secondly, it will not move with the mobile home and provide sufficient strength under the mobile home during severe wind and earthquake conditions. As a consequence, under such conditions, the mobile home shifts and tends to be laterally and longitudinally offset from the piers. The end result is that the mobile home either breaks through the piers after the frame has been moved from the top of the piers or the entire structure splits apart, thereby completely rendering a mobile home obsolete in its destroyed condition.

It is generally a code requirements that mobile homes must not be secured to the substrata by a permanent foundation of footing. As a consequence, the piers 20 and 22 do not form the foundation for a mobile home in the manner of a concrete footing. They merely provide for compressive loading of the home structure from the frame to the underlying substrata. When the foregoing piers are tilted, the invention hereof takes up the loading while still meeting the code requirements of not being secured to the suhstrata.

Looking more particularly at the axle area of the mobile home units 12 and 14, it can be seen that a pair of axles 30 and 32 are utilized to support the mobile home section 12. A second pair of axles 34 and 36 have been utilized to support the adjacent mobile home section 14. The foregoing axles have respective wheeldrums and hub members 40 connected thereto. The wheeldrums 40 can be of the type which have a hub section with bearings upon which the wheeldrum turns. An outer wheel with a tire connected thereto by lug bolts is attached for providing mobility to the home.

Figure 11:
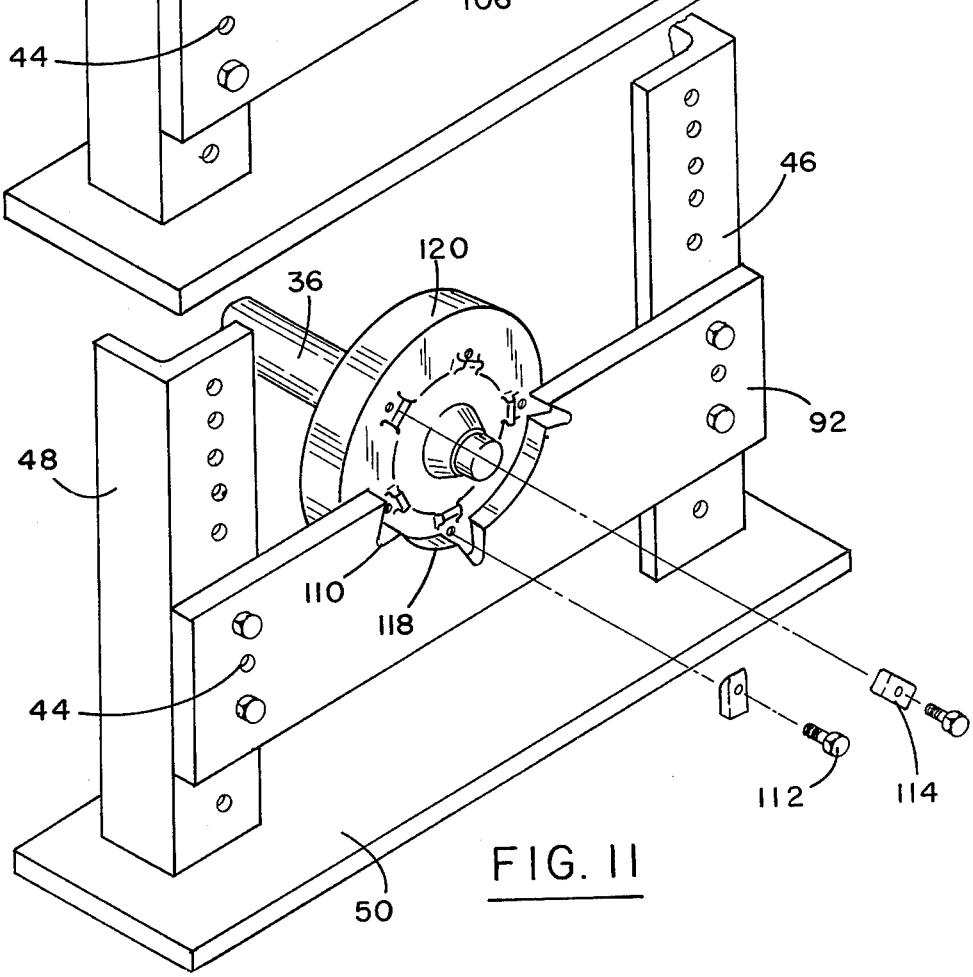

Such wheeldrums 40 provide a number of different lug bolt configurations anywhere from four to six in number, as well as different shapes such as the one commonly referred to as a doughnut, as shown in greater detail in FIG. 11.

The wheeldrums 40 are supported on spanning plates 42. The plates 42 have bolt openings 44 which can be connected to stanchions 46. The stanchions 46 and 48 are angle iron upright members. The stanchions 46 and 48 can be respectively welded or connected to a base plate 50. The base plate 50 can be placed on a broadened concrete footing 52 or any other suitable support. The base plate 50 allows the spring loaded weight of the mobile home to move in case of any substantial movement under severe conditions, yet at the same time remain supported.

For purposes of explanation, a pair of springs 56 and 58 have been shown connected to bolt connections 60 on the base of the mobile home frame. The mobile home frame can be suitably configured to support the mobile home in both its portable mode and its resting mode. Suffice it to say, it is a pre-established configuration which does not bear upon this invention. However, it is accommodated by this invention and supports the underlayment and flooring, as well as the structure of the mobile home.

The wheel drums have lug bolts 64 that are generally used to secure a wheel with a tire thereon. During movement of the home under its portability move, the trailer is towed along the highway with a rubber tire and wheel which is in turn bolted to the wheel drum by way of the lugs 64. The lugs 64 of the prior art can be of the older configuration or of a recent vintage that is known as a doughnut. The doughnut type of configuration has been shown in FIG. 11 wherein a series of bolt holes are utilized for attachment to the wheels by means of bolts or lugs 70.

The stanchions 46 and 48 can be of any angle iron configuration for supporting a compressive load thereon. Also, the plate 42 can be formed of any material, so long as it can take the load imposed upon it by the spring weight of the mobile home as spread through the axles and respective wheel drums 40.

Figure 3:
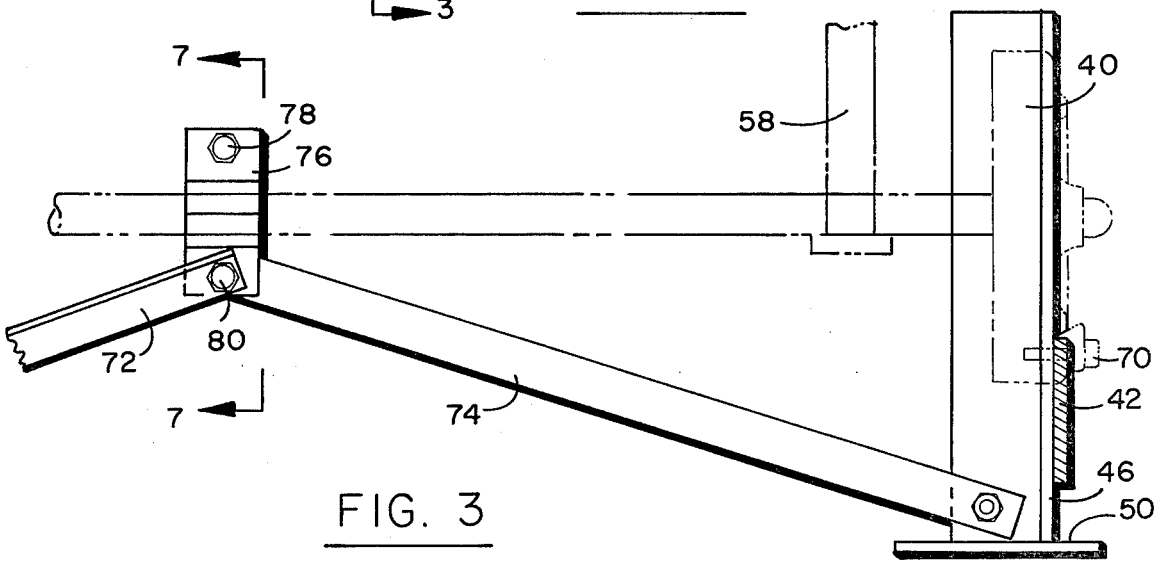
FIG. 3 shows a front elevation view of a fragmented portion of the support of this invention for the axle and the wheel drums of the mobile home in the direction of lines 3—3 of FIG. 2.

The stanchions 46 and 48 are stressed and braced with the respective axles as in the example of FIG. 3 by means of a forward directed cross brace 72 and a rearward directed brace 74. The two respective braces lead from the base of the stanchions in one case from the forward stanchion to substantially the middle of the axles 30, 32, 34 and 36 and are combined with a rearward brace leading to the rear stanchions. Thus, the cross members 72 and 74 provide for lateral sway and movement, as well as longitudinal movement. They also serve to brace the respective stanchions 46 and 48 on either side of the mobile home 10, as well as within the respective upright stanchions themselves.

Figure 7:
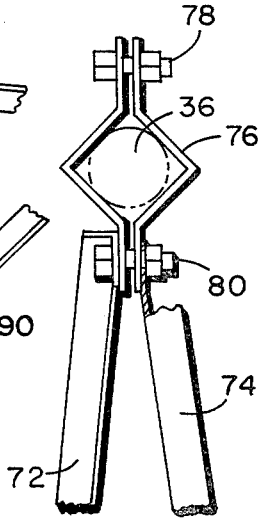
FIG. 7 shows the axle bracket and cross member supports for the axle and wheeldrum support of this invention as fragmented in the direction of lines 7—7 of FIG. 3.

A bracket 76 is shown in FIG. 7 having a diamond shaped tab configuration. The bracket 76 passes around the axle 36 in two bilaterally similar parts and is clamped by an upper nut and bolt combination 78 and a lower nut and bolt combination 80. The diamond shaped bracket 76 is formed from the two respective members as a rectangular or square type of configuration which wraps around the axle 36 and extends in ears upwardly and downwardly, as can be seen in FIG. 7 to accommodate the bolt and nut configuration 78 and 80. Thus, the leading braces 72 and trailing brace 74 can be secured to the axle in a tightened and fixed manner by means of the nut and bolt configuration at the ears.

The foregoing elemental configurations provide for lateral, as well as longitudinal stresses imposed across the base plates 50, allowing it to slide over the substrata or the footing 52 over which it is implaced. It should be understood that the plate 50 must be free to move over the substrata so that under shear forces, the entire unit can move in various directions, while at the same time allowing the static load of the mobile home 10 to be imposed thereon.

Figure 10:
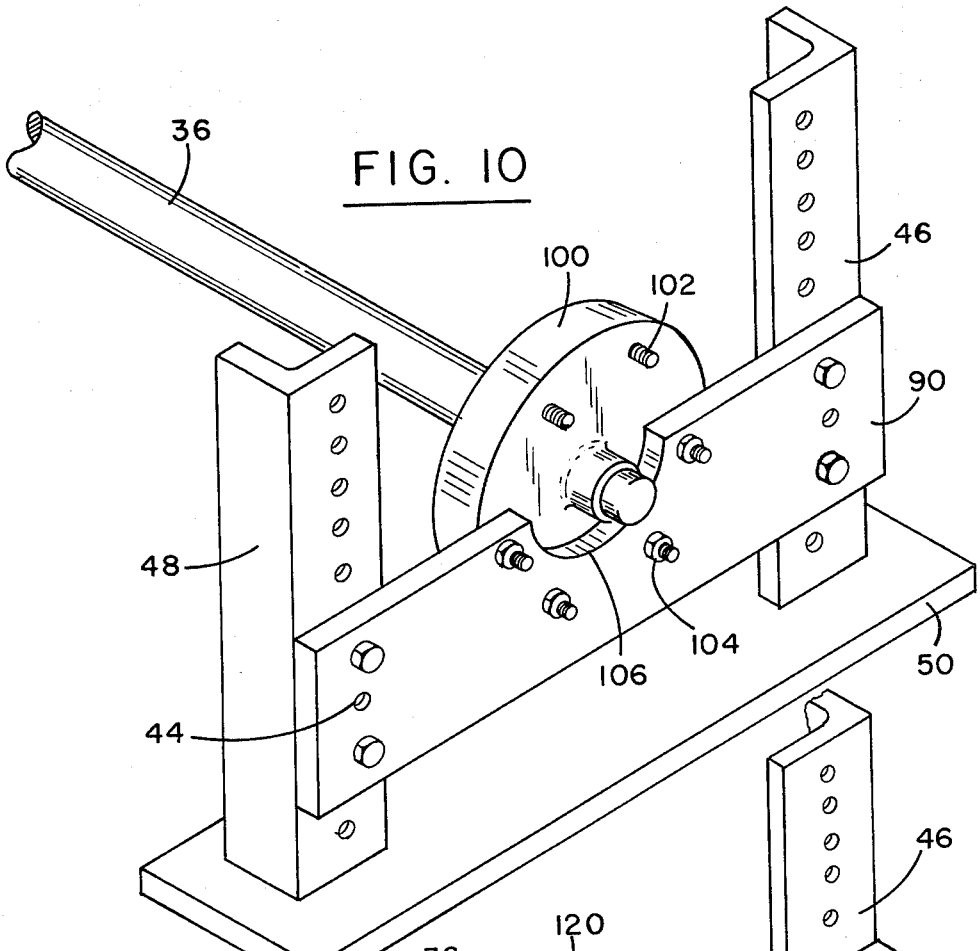
FIG. 10 shows a detailed perspective view of a wheel and axle in the cross support plate and wheel support stanchions wherein the wheeldrum and hub are generally of an older type of model; and, FIG. 11 shows the newer model hub and wheeldrum in perspective view, commonly referred to as a doughnut with its support plate and stanchions.

Looking more particularly at FIGS. 10 and 11, an alternative plate 90 is shown for purposes of receiving a six lug bolt configuration, while FIG. 11 shows a plate 92 that can receive a five lug bolt configuration with regard to a doughnut type of wheeldrum.

Both stanchions 46 and 48 of either configuration have the plural bolt holes for receiving bolts through the openings 44 thereof. Thus, the plate 92 can be moved vertically to different height positions with regard to the stanchions 46 and 48 to accommodate various elevations and sizes of mobile homes.

The wheeldrums 40 are shown connected to an axle 36. However, it should be understood that various differently configured wheeldrums and axle configurations can be employed with this invention. The FIG. 10 showing of the six bolt wheeldrum 100 has lug bolts 102 connected with nuts 104 through openings or bolt holes within the plate 90. In addition thereto, a recess 106 which is common to all of the support or stanchion spanning plate configurations such as plate 42 receives the hub therethrough. The recess 106 of plate 90 is of a smooth arcuate configuration and is formed in a similar manner as that of the previously shown plate 42. In FIG. 11, a second plate 92 is shown having indented inset slots 110 that receive bolts 112 and securement plates 114.

It should be understood that the bolts 112 and securement plates 114 can be substituted by the bolt 70 and securement means generally shown in FIG. 3 as well as any other bolt and lug configuration that is common to various wheeldrums, hubs, and axle members for mobile homes. The plate 92 shown in FIG. 11 for receiving the doughnut type wheeldrum with the respective bolts 112 and securement plates 114 also has a recess 118 into which the hub of the wheeldrum can pass.

It should be understood that the various support or spanning plates 42, 90 and 92 can be configured in any suitable manner for purposes of receiving wheeldrums 40, 100 and the doughnut type of wheeldrum 120 shown in FIG. 11. It is inconsequential except from the standpoint of the respective bolt hole openings, such as in the plates 90 or the slots or openings 110, so long as they accommodate the bolts of the respective drums 40, 100 and 120.

Looking more particularly at the forward portion of the mobile home 10, it is seen that a number of upright stanchions are shown with cross members. The front of the mobile home 10 generally receives a tongue for towing purposes which is attached to a number of bolt holes. The bolt hole arrangement is through a series of bracket plates, namely bracket plates 130 and 132. The bracket plates 130 and 132 are provided with bolt hole openings 140 and 142 which match the respective openings on the floor of the mobile home for the towing tongue attachement. The bolt hole openings 140 and 142 can be substituted with any other suitable means for attachment of the plates 130 and 132 to the bottom of the mobile home.

Figure 4:
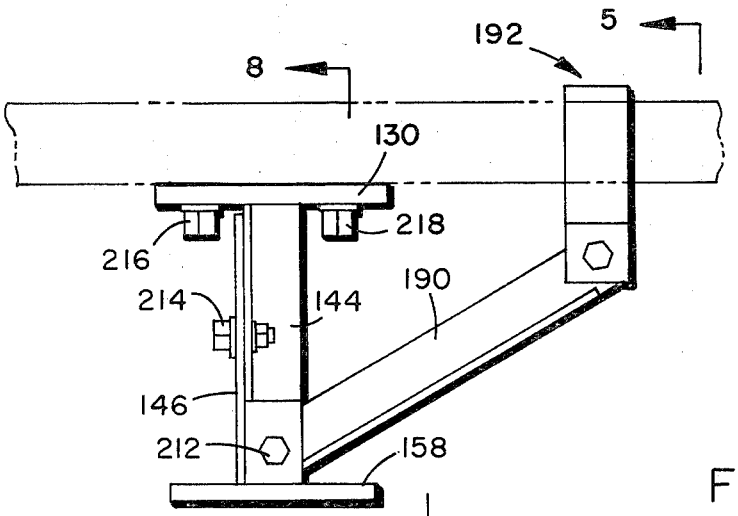
FIG. 4 shows a side elevation view of the frontal support for the mobile home in the direction of lines 4—4 of FIG. 1.
Figure 5:
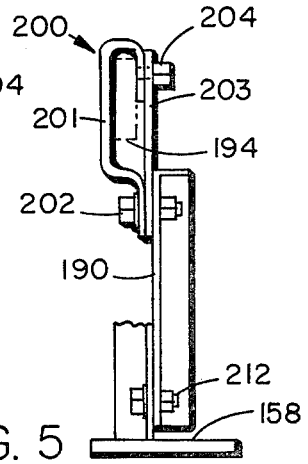
FIG. 5 shows a view looking forwardly of the frame of the mobile home with the bracket and support member of FIG. 4 in the direction of lines 5—5 of FIG. 4.
Figure 8:
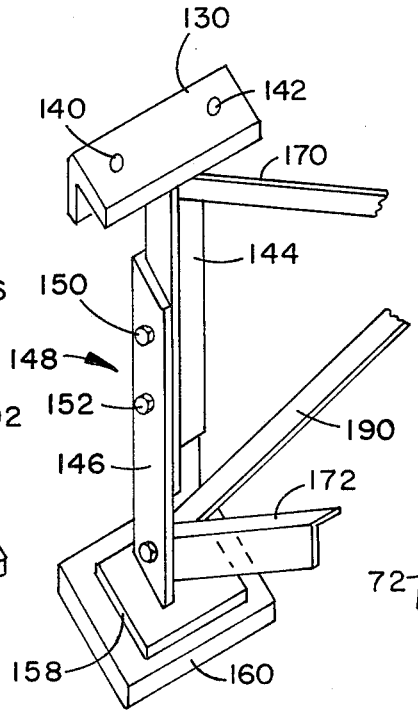
FIG. 8 shows a perspective view of the support stanchions at the front end of the mobile home in the direction of lines 8—8 of FIG. 4.

FIG. 8, which is derived as a view along line 8—8 of FIG. 4 can be seen in greater detail wherein the plate 130 with its openings 140 and 142 has been shown. Suffice it to say, the plate 130 can be of any other suitable configuration but in this case has been shown as an L shaped member. The L shaped member is attached to an upper slidable portion of the stanchion, namely, the member 144. The member 144 is adjustably bolted to a lower upright member 146 forming a composite stanchion 148. The composite stanchion 148 comprising the upper portion 144 and lower portion 146 can be adjustably oriented by means of bolt holes 150 and 152.

The lower member 146 of the composite stanchion 148 is connected to a base plate 158 which can also rest upon a concrete pad or footing 160. The plate 158 rests in any suitable manner, but is allowed to slide backwardly and forwardly on the pad 160 to permit it to comply with code requirements where it cannot be permanently attached to the substrata.

The upper portion of the stanchion 148 has a downwardly projecting cross member 170 and an upwardly extending cross member 172 which connect to the opposite bases and tops of the adjacent stanchion, such as the stanchion connected to plate 132. The two upright stanchions comprising an upper adjustable portion 144 and a lower adjustable portion 146 have cross bracings 170 and 172. The two cross bracing members 170 and 172 can be respectively connected by means of the bolt 180 where they cross over between the two respective stanchions.

A diagonal trailing arm 190 is shown which is connected to a bracket 192. The bracket 192 is clamped to a frame member 194 of the mobile home that runs longitudinally along the length thereof.

The bracket 192 is attached to the frame 194 by means of its bolt and strap configuration comprising a strap member 200 formed as a hook shaped portion 201 in combination with a plate 203. The strap is secured and tightened into position by a lower bolt 202 and an upper bolt 204 securing it around the frame 194.

The frame 194 is fundamentally a channel member or other suitable frame member for purposes of supporting the mobile home. There is a degree of adjustability to the bracket 192 allowing it to fit variously sized frame members 194. The bracket 192 is bolted at its lowest point by bolts 202 to the diagonal strut 190 formed from an L shaped bar. The diagonal strut 190 in turn is connected to the lower portion of the stanchion 146 as previously mentioned, by means of a bolt 212.

The lower portion of the stanchion 146 is adjustable with respect to the upper portion 144 by means of the bolt holes 150 and 152 and the bolt 214 passing therethrough. The bolts passing through the bolt holes 140 and 142 to the frame are shown as bolts 216 and 218. However, it should be understood that the plate 130 can be secured in any particular manner so long as it provides the support necessary to the underside of the frame 194. The reason for the orientation of the bolt holes and the plate 130 is fundamentally that they are normally of the same size as the towing tongue attachment bolt holes. As a consequence, the support is easily adapted to meet code requirements due to the fact that there are no permanent attachments allowed for mobile homes generally under the code other than those originally used, namely the wheeldrum configuration and the tongue attachment means.

The foregoing configuration of the stanchions, plates upon which they rest, and means for supporting the wheel drums and the front of the mobile home, provide for substantial protection during an earthquake. Fundamentally, the home is supported in the same manner as it is in over the road portable towing modes. During an earthquake, the tongue support area receives approximately one third of the weight of the mobile home and the axle area receives approximately two thirds of the mobile home's weight. Thus, during such conditions, the home is capable of moving on its respective plates 50 and 158 both in lateral and longitudinal firections, as well as up and down, during any kind of severe movement.

In light of the foregoing, this invention should be read broadly as a means for supporting a mobile home while it is at rest through its normal movement supports. At the same time, it allows the mobile home to be supported without being affixed to the ground or substrate. In this manner, the code requirements, as well as the general support of the mobile home can be accounted for during strenuous natural causes. Thus, the invention should only be read in light of the following claims hereinafter.

I claim:

1. A mobile home support comprising:

a first plurality of stanchions;

a base member attached to said stanchions for placement on substrata in a manner permitting movement thereof on said substrata;

means on said stanchions for affixing them to the axle of a mobile home;

at least one second stanchion adapted for placement in the forward area of the mobile home;

means for connecting said second stanchion to the bottom of said mobile home;

a plate connected to said second stanchion for said second stanchion to rest upon adapted for movement over the substrata upon which said stanchion is placed;

means on said first stanchions having openings adapted to receive the wheel drum lugs of a mobile home; and, at least one cross bracing member connecting said first stanchions to a point on said axle between the wheeldrums.

2. The mobile home support as claimed in claim 1 wherein:

said second stanchion is adapted for placement and connection to the mobile home tongue pulling connection means after removal of said tongue pulling means.

3. The mobile home support as claimed in claim 2 comprising:

at least a pair of said second stanchions for connection to said respective tongue connection means of said mobile home; and, at least one cross bracing member between said second stanchions.

4. The mobile home support as claimed in claim 3 further comprising:

a pair of cross braces between said second stanchions forming said second stanchion's bracing.

5. The mobile home support as claimed in claim 3 further comprising:

a diagonal brace extending from the foot of one of said second stanchions diagonally upward; and, a bracket for attachment of said diagonal brace to said mobile home.

6. The mobile home support as claimed in claim 5 wherein said bracket comprises:

a strap adapted for surrounding at least a portion of said mobile home frame.

7. The mobile home support as claimed in claim 3 further comprising:

a clamping means for connection to said brace from said first stanchion to said axle having a pair of members that can be clamped around said axle and tightened thereto while at the same time providing securement of said brace between said axle and said stanchion.

8. The mobile home support as claimed in claim 7 further comprising:

at least two braces forming said brace between said axle bracket and the base of said stanchions.

9. The mobile support as claimed in claim 8 wherein:

all of said stanchions have adjustable bolt hole openings to allow for different heights of support for mobile homes.

10. The mobile home support as claimed in claim 9 further comprising:

support plates between said first stanchions for providing the support means for said wheeldrums and having openings therein to receive the lugs of a wheeldrum.

11. A mobile home support adapted for attachment to the portable loading support when said mobile home is being moved having a base capable of moving over the substrata over which the mobile home is placed comprising:

at least two pairs of stanchions wherein each pair has a plate spanning between the stachions;

a base plate connected to said stanchions upon which said stanchions can rest, while at the same time allowing said base plates to be displaced from said substrata upon movement of said mobile home;

means within said plate spanning said stanchions for receiving the lug bolts of the wheel drums attached to the axle of a mobile home; and, rigidifying means adapted for connection between the axle and said stanchions.

12. The mobile home support as claimed in claim 11 further comprising:

second stanchion means having an upper plate for connection to the tongue towing area of a mobile home; and, a base plate for said second stanchion which allows said second stanchion to move over said substrata; and, bracing means between said second stanchion and the frame of said mobile home.

13. The mobile home support as claimed in claim 12 further comprising:

a cross bracing member connected between said first stanchions and the axle of the mobile home; and, a bracket for connection to said axle and said cross member for rigidifying the respective stanchions in combination with said axle.

14. The mobile home support as claimed in claim 13 wherein:

said second tongue support area stanchions are cross braced between each other respectively; and, said brace between said second stanchions and the mobile home frame comprises a diagonal member between one of said tongue stanchions for connection to the frame and said mobile home by clamping bracket means.

* * * * *